US005643410A

United States Patent [19]

Hiljanen et al.

[11] Patent Number: 5,643,410

[45] Date of Patent: Jul. 1, 1997

[54] BATCH PROCESS FOR PREPARING KRAFT PULP IN A BATCH DIGESTING PROCESS

[75] Inventors: Seppo T. Hiljanen, Nakkila; Panu O. Tikka, Kantvik, both of Finland

[73] Assignee: Sunds Defibrator Rauma Oy, Finland

[21] Appl. No.: 997,649

[22] Filed: Dec. 28, 1992

Related U.S. Application Data

[63] Continuation of Ser. No. 760,133, Sep. 16, 1991, abandoned.

[30] Foreign Application Priority Data

Jun. 28, 1991 [FI] Finland ..... 913160

[51] Int. Cl.[6] ..... D21C 9/00; D21C 9/04; D21C 7/12

[52] U.S. Cl. ..... 162/37; 162/40; 162/47; 162/52; 162/59; 162/60; 162/61

[58] Field of Search ..... 162/29, 47, 49, 162/52, 60, 59, 61, 16, 62, 51, 248, 249, 250, 37, 38, 40

[56] References Cited

U.S. PATENT DOCUMENTS

| | | | |
|---|---|---|---|
| 1,938,957 | 11/1933 | Wells | 162/60 |
| 2,671,727 | 3/1954 | Westcott et al. | 162/62 |
| 4,578,149 | 3/1986 | Fagerlund | 162/47 |
| 4,849,052 | 7/1989 | Grant | 162/45 |
| 5,015,333 | 5/1991 | Grant | 162/60 |

FOREIGN PATENT DOCUMENTS

WO9106702 5/1991 WIPO .

OTHER PUBLICATIONS

European Patent Office Communication, European Search Report, Oct. 15, 1992.

*Primary Examiner*—Steven Alvo

*Attorney, Agent, or Firm*—Lerner, David, Littenberg, Krumholz & Mentlik

[57] ABSTRACT

Methods for discharging spent cooking liquors from a batch digester containing cooked lignocellulose-containing material in spent cooking liquor are disclosed, including supplying a first portion of washing liquid to the digester to displace a first portion of the spent cooking liquor at a temperature and dry solids content which substantially corresponds to the temperature and dry solids content of the spent cooking liquor at the end of the batch digestion, supplying a second portion of washing liquid to the digester to displace a second portion of the spent cooking liquor having a temperature and dry solids content substantially lower than that of the spent cooking liquor in the digester, and maintaining the first and second portions of spent cooking liquor separate from each other. Methods of producing kraft pulp in batch digesting processes using this method are also disclosed.

17 Claims, 3 Drawing Sheets

Fig. 4.
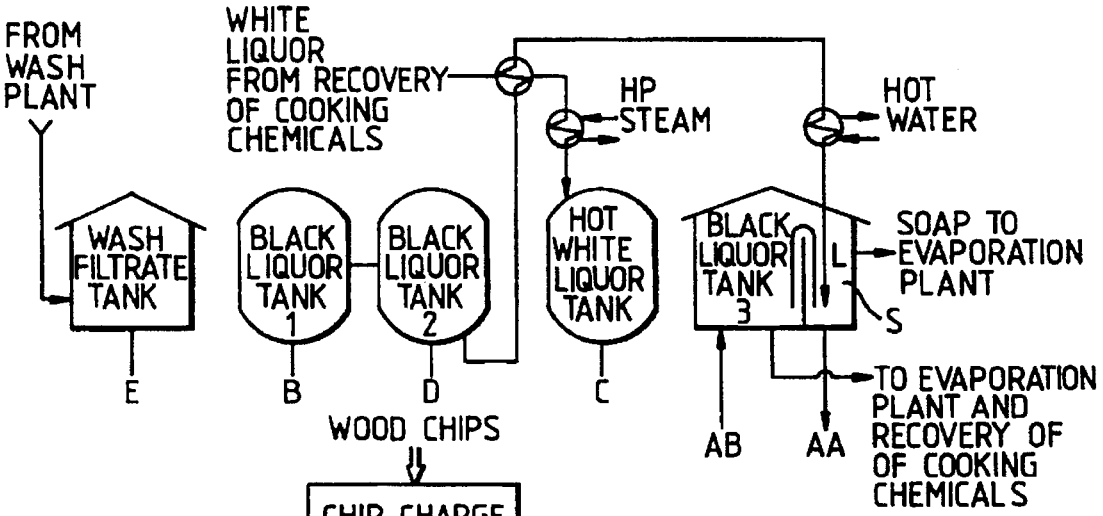
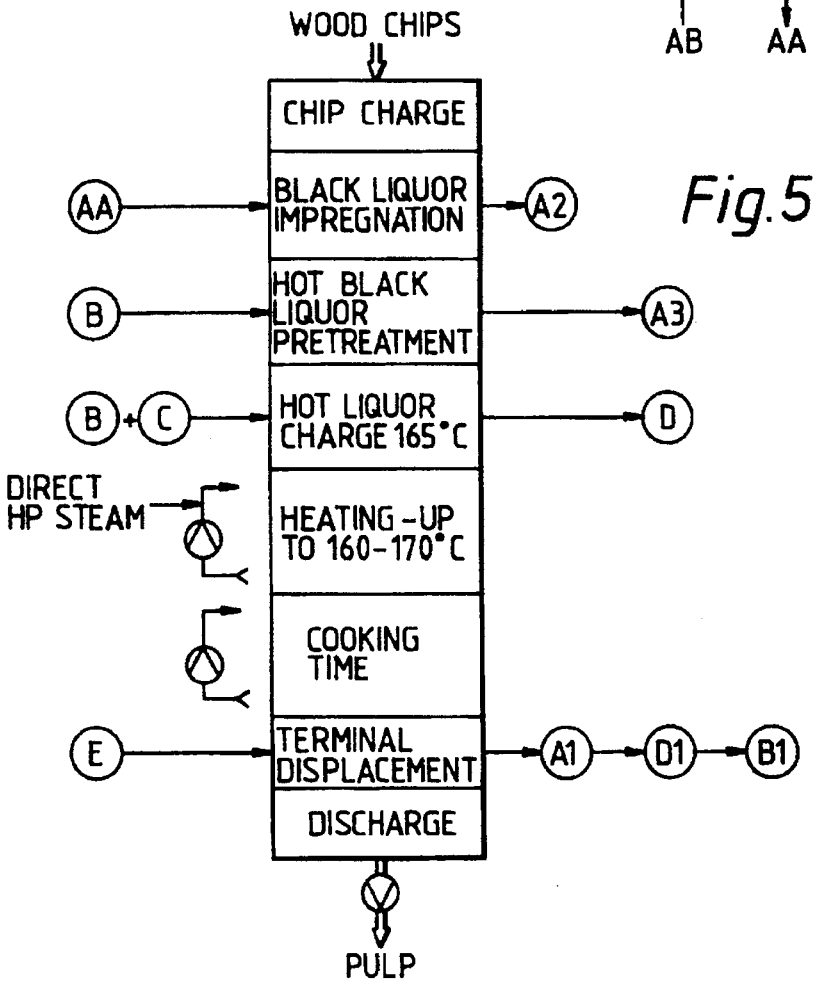
Fig. 5.

BATCH PROCESS FOR PREPARING KRAFT PULP IN A BATCH DIGESTING PROCESS

This is a continuation of application Ser. No. 07/760,133 filed Sep. 16, 1991now abandoned.

FIELD OF THE INVENTION

The present invention relates to processes for preparing kraft pulp in which cellulosic material is treated with recycled pulping process liquids and fresh white liquor for dissolving the lignin therein. More particularly, the present invention relates to the recycling of spent cooking liquor from batch kraft cooking, and the advantageous reclamation of active dry solids and heat therein, while purging the harmful soap separating therefrom.

BACKGROUND OF THE INVENTION

In the kraft cooking process cellulosic material, most conveniently in form of chips, is treated at elevated temperatures with alkaline cooking liquor containing sodium hydroxide and sodium hydrogen sulfide. The fresh inorganic cooking liquor is referred to as white liquor, and the spent liquor containing the dissolved wood material is referred to as black liquor.

Since the initiation of kraft cooking processes to the present date, one of the most important objectives therein has been the attempt to reduce the energy consumption required to heat up the chips and chemicals. The method generally employed has been to recover heat energy at the end of the cooking process as it can then be used at the beginning of the process, as the chips and chemicals are brought together. In continuous cooking processes, this takes place by heating the chip material with secondary steam obtained from flashing the hot black liquor. In discontinuous, or batch cooking processes, however, the most useful technique is to use the recovered hot black liquor 1) as a direct heating media to be pumped into the digester and 2) to heat-up white liquor by means of heat exchangers.

In connection with this type of low-energy batch cooking, several methods for energy reclamation have been proposed. Some of these developments have resulted in industrial scale embodiments. Perhaps the most useful prior art method to date is that described in U.S. Pat. No. 4,578,149 by B. K. Fagerlund. This patent relates to an invention in which hot black liquor is displaced from the top of a batch digester to a particular hot black liquor accumulator by pumping wash filtrate into the bottom of the digester. This displacement into the accumulator is continued until the thermal displacement shows a clear drop in temperature after which the liquor is conducted to a separate tank for lower temperature black liquor. The reclamation of heat is then carried out by first pumping lower temperature black liquor into the next batch, and by then pumping hot black liquor from a hot black liquor accumulator, as well as hot white liquor warmed up by heat exchange with part of the hot black liquor into the batch. In this process the digester is brought up to a temperature approximately 20° C. below the final cooking temperature, thus providing for a major portion of the energy required in the form of fresh steam for heating the liquor in conventional batch cooking processes. In general, this technology can be classified as a "Two Tank" concept, i.e.—one black liquor accumulator for "hot" liquor and another one for "lower temperature" liquor.

The development of batch cooking technology has thus been characterized by improvements in terms of energy savings therein. Very little attention has been paid, however, to other important issues in cooking technology, such as the effect and variability of the properties of recovered black liquors, uniform cooking conditions, uniform pulp quality, and the sensitivity of these operations to disturbances therein. As an example, such a critical operational necessity as the removal of soap that separates from black liquors has not even been mentioned in the prior low-energy batch literature. The failure to consider these issues, however, has to a great extent been responsible for the tedious and troublesome start-ups of some low-energy batch digesters as well as operation in less than optimal conditions, which results in disturbances, production losses and variability in the degree of cooking and in pulp quality.

SUMMARY OF THE INVENTION

In accordance with the present invention, these and other objects have now been realized by the discovery of a method for discharging spent cooking liquor from a batch digester containing cooked lignocellulose-containing material in spent cooking liquor having a predetermined temperature and dry solids content, which method comprises supplying a first portion of a washing liquid to the digester in order to displace a first portion of the spent cooking liquor from the digester, the first portion of the spent cooking liquor having a temperature and dry solids content substantially corresponding to the predetermined temperature and dry solids content, supplying a second portion of washing liquid to the digester so as to displace a second portion of the spent cooking liquor from the digester, the second portion of spent cooking liquor having a temperature and dry solids content substantially lower than the predetermined temperature and dry solids content, and maintaining the first and second portions of spent cooking liquor separate from each other. In accordance with one embodiment of the method of the present invention, the predetermined temperature comprises the cooking temperature for the batch digester, and the temperature substantially lower than the predetermined temperature comprises a temperature corresponding to the boiling point of the cooking liquor at atmospheric pressure.

In accordance with one embodiment of the method of the present invention, the method includes monitoring the dry solids content of the spent cooking liquor in order to determine when the first portion of the spent cooking liquor has been obtained.

In accordance with another embodiment of the method of the present invention, the method includes monitoring the temperature of the spent cooking liquor in order to determine when the second portion of the spent cooking liquor has been obtained.

In accordance with yet another embodiment of the method of the present invention, the method includes employing the first portion of the spent cooking liquor as a heating liquor for cooking a subsequent batch of lignocellulose-containing material.

In another embodiment, the method of the present invention includes employing the second portion of the spent cooking liquor as a source of heat for heating liquor for cooking a subsequent batch of lignocellulose-containing material. In a preferred embodiment, this method includes transferring the second portion of the spent cooking liquor to a liquor tank maintained at atmospheric pressure.

In accordance with one embodiment of the method of the present invention, the method includes supplying a third portion of the washing liquid to the digester so as to displace a third portion of the spent cooking liquor from the digester, the third portion of the spent cooking liquor having a temperature lower than the temperature corresponding to the boiling point of the cooking liquor at atmospheric pressure.

In accordance with the present invention, a method has also been discovered for producing kraft pulp in a batch digesting process comprising charging lignocellulose-containing material to a batch digester, impregnating, pretreating and heating the lignocellulose-containing material by the addition of spent cooking liquor and/or fresh alkaline cooking liquor to the batch digester, cooking the lignocellulose-containing material at a predetermined cooking temperature so as to produce cooked lignocellulose-containing material having a predetermined temperature and dry solids content, discharging the spent cooking liquor from the batch digester by supplying a first portion of a washing liquid to the digester so as to displace a first portion of the spent cooking liquor from the digester, the first portion of the spent cooking liquor having a temperature and dry solids content substantially corresponding to the predetermined temperature and dry solids content, supplying a second portion of washing liquid to the digester so as to displace a second portion of the spent cooking liquor from the digester, the second portion of the spent cooking liquor having a temperature and dry solids content substantially lower than the predetermined temperature and dry solids content, maintaining the first and second portions of the spent cooking liquor separate from each other, utilizing the first portion of the spent cooking liquor for the pretreating and heating of the lignocellulose-containing material in a subsequent batch of lignocellulose-containing material, and utilizing the second portion of the spent cooking liquor for supplying heat to a subsequent batch of lignocellulose-containing material.

In a preferred embodiment of this method of the present invention, the method includes transferring the second portion of the spent cooking liquor, after supplying heat to the subsequent batch of lignocellulose-containing material, to a liquor tank maintained at atmospheric temperature. Preferably, this method includes separating and removing soap contained in the second portion of the spent cooking liquor in the liquor tank. More preferably, the liquor tank includes a primary compartment and a secondary compartment in liquid contact with each other, and the method includes transferring the second portion of the spent cooking liquor to the secondary compartment in the liquor tank. Most preferably, this method includes separating and removing soap from the second portion of the spent cooking liquor in the secondary compartment of the liquor tank.

In accordance with one embodiment of this method of the present invention, the method includes utilizing the second portion of the spent cooking liquor for impregnating the lignocellulose-containing material in a subsequent batch of lignocellulose-containing material. In a preferred embodiment, this method includes utilizing the second portion of the spent cooking liquor from the secondary compartment of the liquor tank for impregnating the lignocellulose-containing material in a subsequent batch of lignocellulose-containing material.

In accordance with another embodiment of this method of the present invention, the method includes utilizing the second portion of the spent cooking liquor for pre-heating fresh alkaline cooking liquor supplied to the digester in a subsequent batch of lignocellulose-containing material.

In another embodiment, this method includes supplying a third portion of washing liquid to the digester so as to displace a third portion of the spent cooking liquor from the digester, the third portion of the spent cooking liquor having a temperature lower than the temperature comprising the boiling point of the cooking liquor at atmospheric pressure. In a preferred embodiment, the washing liquid comprises a filtrate from a subsequent wash plant for kraft pulp.

In general, the present invention thus provides for overcoming the weaknesses in prior art low energy batch kraft cooking processes by means of a process for preparing kraft pulp which employs three tanks dedicated to particular black liquors, a new liquor recycling sequence, and the removal of soap at an optimum location in the process.

BRIEF DESCRIPTION OF THE DRAWINGS

In order to provide a proper description of the present invention and its comparison to the state of the art, it is crucial to understand exactly what happens in a terminal displacement of the kraft batch digester from the top of the digester by using wash filtrate pumped to the bottom of the digester. This understanding is more easily provided with reference to the following detailed description, which refers to the figures in which;

FIG. 4 is a schematic representation of the tanks and liquor transfer sequences according to the method of the present invention.

FIG. 5 is a schematic representation of a kraft batch cooking process in accordance with the present invention.

DETAILED DESCRIPTION

Figure 1:
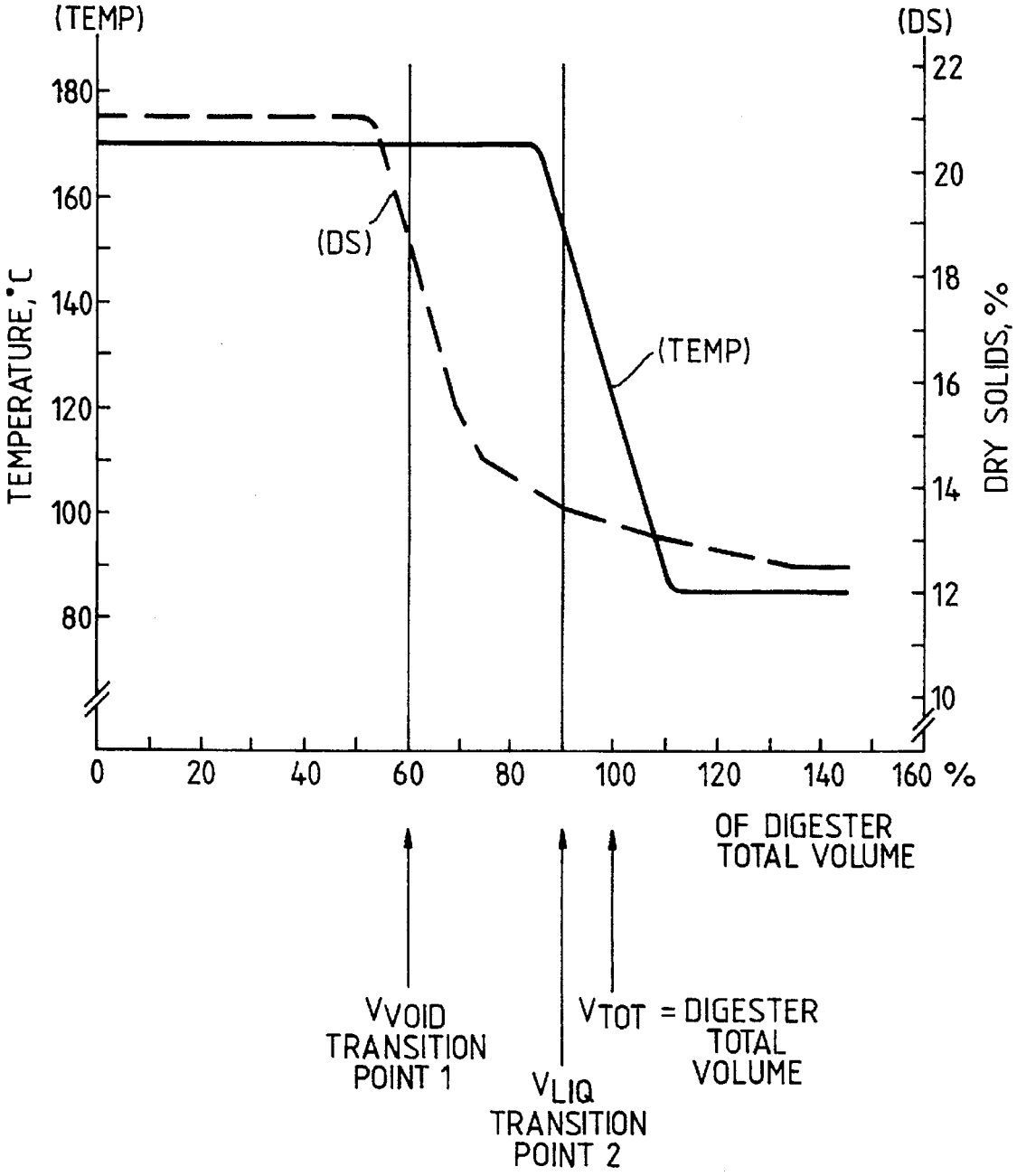
FIG. 1 is a graphical representation of the development of temperature and dry solids concentration in a displaced black liquor leaving the digester.

Referring first to FIG. 1, this figure specifically shows the development of temperature and dry solids concentration of displaced black liquor leaving the digester. It is particularly important in order to understand the present invention to define different characteristic volume percentages describing different aspects of the volume of liquid filling the digester. Thus, and again referring to FIG. 1, Vtot, or digester total volume, means the total volume of the empty digester vessel; Vvoid, or digester free, or void volume, means the volume of the digester which is not filled by the chips; therefore, Vvoid=Vtot−Vchip volume. Vliq, or, digester liquid carrying capacity, means the sum of digester void liquid volume and liquid volume in chip material, or Vliq=Vtot−Vsolid phase.

In FIG. 1 the digester total volume, or Vtot, is marked to be 100%. In FIG. 1 the digester liquid-carrying capacity is Vtot minus the volume of the solid phase, or the fiber material, that is typically 90%. (The 90% liquid-carrying capacity value, i.e. all of the liquid in the digester, is derived from the fact that the final pulp consistency in a hydraulically full batch digester is about 10%, thus 90% being liquid.)

In FIG. 1 the digester void (free) volume, Vvoid, is the space not filled by chips, or is Vtot minus chip volume, and is typically 60%. (The 60% free liquid volume value is derived from the fact that softwood chips filling a batch digester typically fills about 160 kg of absolute dry wood solids per digester cubic meter. Furthermore, the specific density of softwood is about 0.4 kg per liter of wood material, thus providing a wood-filled space of about 0.4 $m^3$ per digester $m^3$, therefore, 0.6 $m^3$ thereof is left for free liquid. Of course, this figure varies somewhat according to the degree of chip packing and with the specific density of the wood.)

When pumping colder wash filtrate, which is essentially at a temperature below the boiling point, or about 85° to 90° C., and having a dry solids content of 12%, to the bottom of the digester, the black liquor leaving from the top of the digester will have properties that differ according to the volume of filtrate pumped into the digester.

After pumping in about 60% of the Vtot the digester void volume is at a point where it is about to be completely replaced by the wash filtrate, which will subsequently start flowing out of the digester. This point (transition point 1) is seen in the "dry solids displacement curve" (DS) shown in FIG. 1, which then rapidly declines, tailing down towards the dry solids concentration of the wash filtrate, since the diffusion of dry solids from the internal volume of the chips to the void liquid is a slow process. The wash filtrate concentration level is first reached only after extended displacement volume, i.e.—at 130–140% of the digester total volume. However at transition point 1 the temperature of the liquor leaving the digester is still close to the cooking temperature, due to the rapid heat transfer which takes place from the internal volume of the chips, which includes an almost immobile liquid, to the moving liquor in the void volume.

After pumping in about 90% of the Vtot, the displaced volume equals approximately 100% of the liquid carrying capacity of the digester, and the internal chip heat content is almost totally conducted into the subsequently heated wash filtrate. This point (transition point 2) is seen in the "thermal displacement curve" (TEMP) shown in FIG. 1 which declines rapidly, tailing down towards the temperature of the wash filtrate.

Figure 2:
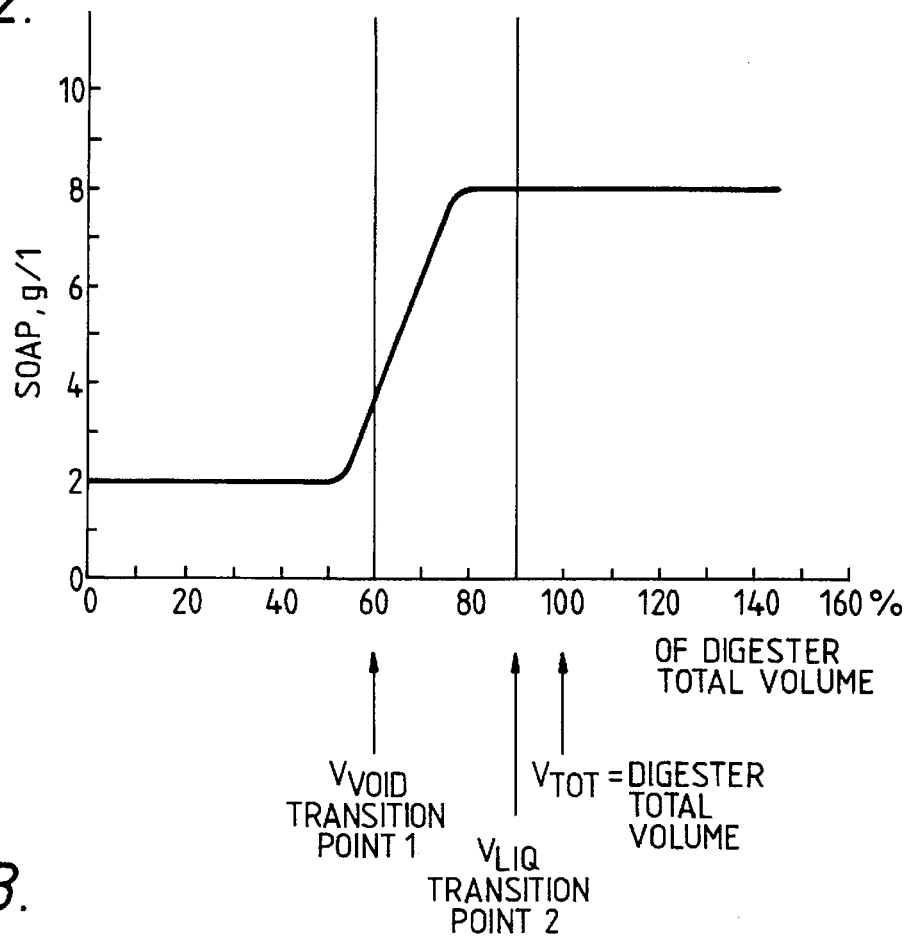
FIG. 2 is a graphical representation of the soap concentration during terminal displacement of the kraft batch digester as a function of pumped wash filtrate volume as the percentage of digester volume.

FIG. 2 shows the behavior of soap concentration during terminal displacement of the kraft batch digester as a function of the volume of pumped wash filtrate as a percentage of digester Vtot. It is important to note the opposite development of soap concentration, which is due to the fact that the wash filtrate has a higher soap concentration, i.e.—about 8 g/l, than that of the black liquor at the end of the cook, i.e.—about 2 g/l, and which therefore results in the soap concentration of the liquor leaving the digester starting to increase at transition point 1, when the wash filtrate starts to break through. As the portion of the wash filtrate increases, as displacement proceeds, this concentration then approaches that of the wash filtrate.

According to the prior art, as in U.S. Pat. No. 4,578,149, for example, the displaced liquor is recovered to the hot black liquor accumulator according to the thermal displacement, i.e.—the cut-off to the lower temperature accumulator is determined according to transition point 2. This procedure evidently efficiently recovers the heat, but fails to maintain constant black liquor quality. As the displacement proceeds over 60% of Vtot, the dry solids curve drops sharply. When approaching 90% of displaced volume, the dry solids concentration has decreased close to that of the wash filtrate. As a consequence, the concentration of useful cooking chemicals, and especially residual alkali and sulphur, is very low at the end of the recovery of the hot black liquor. This diluted liquor, however, enters the hot black liquor accumulator, and as the hot black liquor is used for following cooks, black liquor of varying chemical composition will be charged. Consequently, the cooking conditions will vary therein, causing unavoidable variations in the degree of cooking and in the pulp quality. Also, large amounts of undesirable soap are simultaneously recovered in the hot black liquor accumulator.

Figure 3:
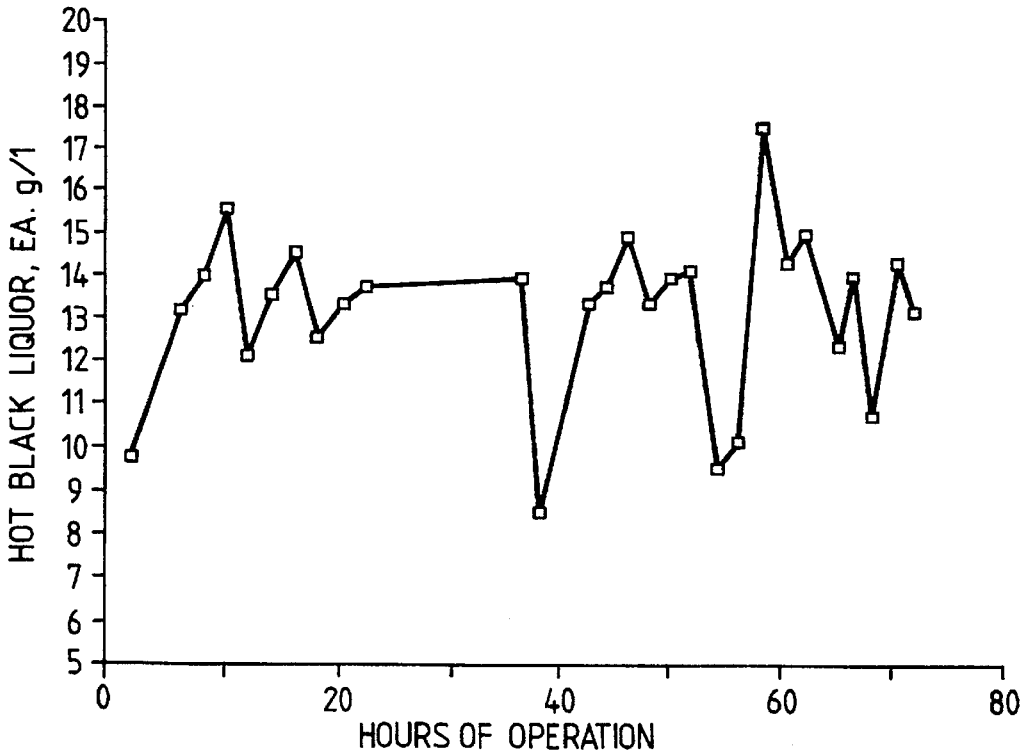
FIG. 3 is a graphical representation of residual alkali concentrations of hot black digester charges.

FIG. 3 illustrates residual alkali concentrations as measured from hit black liquor charges entering an industrial kraft batch digester in a digester house operated according to the process described in U.S. Pat. No. 4,578,149. It is evident therefrom that the residual alkali concentration varies randomly between about 10 and 17 g of Effective Alkali per liter, precisely as FIG. 1 would anticipate, i.e.—the dry solids concentration can vary between about 12.5 and 21%.

Referring next to FIG. 4, the tanks and liquor transfer sequence of the present invention are illustrated. According to the invention, at the end of a kraft batch cook, the terminal displacement of digester liquor by pumping wash filtrate E to the bottom of the digester is first carried out to the first transition point (see FIG. 1) removing essentially all of the rich spent liquor at cooking temperature and pressure from the free liquid volume. This displaced liquor is digested as B1 and is transferred to the black liquor tank 1, at point B. The exact volume to be recovered is most suitably controlled by monitoring the dry solids concentration in the displaced liquor exiting from digester top with conventional dry solids analyzers. After detecting a clear drop in dry solids concentration, the displaced liquor is switched to enter black liquor tank 2 until a temperature close to the atmospheric boiling point thereof is reached. This displaced liquor is referred to as D1 and is thus recovered. This end point is clearly farther than the transition point 2 (see FIG. 1), which corresponds to the displacement volume at which the heat content of the liquid-carrying capacity volume is being recovered in the displacing wash filtrate, meaning that a complete heat recovery has taken place. In order to further wash the pulp, the pumping of wash filtrate can then be continued, and the corresponding displaced liquor A1 is led to the atmospheric black liquor tank 3, at point AB.

It is noteworthy that when proceeding in this manner, the first black liquor portion, B1, is both 1) essentially at cooking temperature and 2) at the dry solids concentration at the cooking end point. No prior art technology is able to fulfill these two important requirements for purity in a single liquor located in a dedicated tank. On the other hand, the second recovered black liquor, D1, contains diluting wash filtrate which starts to break through at the transition point 1. It is important to note that black liquor, D1, is of varying black liquor quality, and also contains most of the soap since the soap concentration, see FIG. 2, first increases when the filtrate is breaking through into the black liquor after transition point 1. No prior art technology is able to recover a single portion of black liquor in a dedicated tank that contains all of the variability in dry solids content and temperature, and a selectively higher soap concentration. The mixed liquor in black liquor tank 2 is used solely to heat up white liquor and warm water in heat exchangers, and to then end up in black liquor tank 3, compartment S, to be further used as impregnation black liquor AA.

The black liquor tank 3, and its compartment S, now have a significant new role in kraft cooking. That is, the function of receiving compartment S is to remove the separating soap from the cooled and depressurized black liquor from black liquor tank 2, and to isolate the low-in-soap black liquor for impregnation purposes. Compartment S is connected to the main reservoir of the black liquor tank 3 by a pipe that extends from near the bottom thereof in order to prevent the soap from entering the other side or compartment thereof.

No prior art technology is able to separate soap from the recovered black liquor and to selectively feed the low-in-soap black liquor back into the process. Practical experience in industrial processes has proven that soap removal in this location of the black liquor transfer sequence is of major importance. Technology such as that described in U.S. Pat. No. 4,579,149 does not even recognize the soap problem, and clearly provides no solution for dealing therewith. In addition, this type of two tank heat recovery concept must, by its very nature, be pressurized, which therefore effectively prevents one from removing the separated soap therefrom. As a consequence, the prior art technology is hampered by repeated operational problems, when the accumulated soap in the black liquor tanks slowly gets transferred to the digester, causing severe problem in maintaining digester circulation, and in preventing efficient liquid displacement operations.

According to the present invention, and as illustrated in FIG. 5, the kraft batch cook is instituted by filling the digester with chips, filling the digester and soaking the chips with low-in-soap black liquor AA from receiving compartment S in black liquor tank, 3, in order to fully impregnate the chip material with black liquor. The use of an overflow, A2, back to black liquor tank 3, at point AB, is preferred, in order to remove air and the first diluted material. During impregnation, a rather low temperature, below the boiling point, is preferred, since higher temperature impregnation will consume the residual alkali too fast, thus causing impregnation with zero residual alkali black liquor, in turn resulting in higher rejects and non-uniform cooking. This, in fact, is another advantageous feature of the present invention, since the black liquor AA is inherently at the desired temperature, contrary to prior art technologies which feed in black liquor for impregnating at temperatures well above the boiling point.

The black liquor impregnation step is terminated by pressurizing the digester in order to avoid flashing during the following steps, that introduce higher temperature liquors. According to the present invention, the kraft cooking process is then continued by pumping in hot black liquor, B, from black liquor tank 1. In contrast to the prior art, black liquor from tank 1 is of constant temperature and dry solids concentration, which makes it easy to repeat exactly the same hot black liquor charge from cook to cook. This is extremely important because the hot black liquor step has a major chemical effect on the wood, and controls the selectivity and cooking kinetics in the main cooking phase with white liquor. In the prior art, the effect of hot black liquor has been neglected, and a good portion of the reaction degree and variability in pulp quality can be related to the uncontrolled properties of the black liquor quality.

Therefore, in the case of low-energy, displaced kraft batch cooking, it is particularly beneficial to combine the present invention with a novel kraft cooking method as set forth in U.S. Pat. No. 5,183,535, the disclosure of which is incorporated herein by reference thereto, taking advantage of a well controlled black liquor treatment in terms of more effective cooking and improved pulp quality.

The cooler black liquor, A3, which has been displaced by hot black liquor is conducted to black liquor tank 3, at point AB, for discharge to the evaporation plant and for the recovery of cooking chemicals.

The cooking sequence is continued by pumping in hot white liquor from the hot white liquor storage tank, C, and a smaller amount of hot black liquor, B, 1) simultaneously with the hot white liquor, in order to recover as much heat as possible, and to dilute the very high alkali concentration of fresh white liquor and 2) after white liquor charge, in order to flush the lines into the digester. The total volume of hot black liquor, B, consumed in this sequence corresponds to the volume of the recovered hot black liquor, B1, from the previous batch. The displaced liquor, D2, above about atmospheric boiling point, is conducted to hot black liquor tank 2.

After the above-described filling procedure, the digester temperature is relatively close to the final cooking temperature. The final heating up is carried out in conventional manner by using direct or indirect heating. After cooking reactions have proceeded to the desired reaction degree, the batch is ready to be displaced with wash filtrate E as described at the beginning of this description. The sequence can then repeat itself.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method of producing kraft pulp in a batch digesting process comprising the steps of:

charging lignocellulose-containing material to a batch digester;

pretreating said lignocellulose-containing material;

adding fresh alkaline liquor for cooking to said batch digester;

cooking said lignocellulose-containing material at a cooking temperature and cooking pressure so as to produce cooked lignocellulose-containing material and cooking liquor;

said cooking liquor being at said cooking temperature and cooking pressure and having an initial dry solids content;

displacing a portion of said cooking liquor at said cooking temperature and pressure from said batch digester to a first accumulator by supplying a washing liquid to said digester until said dry solids content of said displaced cooking liquor drops relative to said initial dry solids content, so as to obtain a first portion of displaced cooking liquor having a temperature, pressure and dry solids content substantially corresponding to said cooking temperature and pressure and said initial dry solids content of said cooking liquor; and, after said drop in dry solids content, further displacing a second portion of liquid from said digester to at least a second accumulator by supplying further washing liquid to said digester until the temperature of said displaced second portion of liquid drops to a temperature of at least about the boiling point of said cooking liquor, at atmospheric pressure, so as to obtain a second portion of displaced liquid having a dry solids content substantially lower than said initial dry solids content of said cooking liquor.

2. The method of claim 1 further comprising the step of monitoring said dry solids content of said cooking liquor in order to determine when to terminate the collection of said first portion of said cooking liquor.

3. The method of claim 1 further comprising the step of monitoring said temperature of said second portion of liquid in order to determine when to terminate the collection of said second portion of displaced liquid.

4. The method of claim 1 further comprising the step of employing said first portion of said cooking liquor as a heating liquor for cooking a subsequent batch of said lignocellulose-containing material.

5. The method of claim 1 further comprising the step of employing said second portion of liquid as a source of heat for heating liquor for cooking a subsequent batch of said lignocellulose-containing material.

6. The method of claim 1 further comprising the step of transferring said second portion of liquid to a liquor tank maintained at atmospheric pressure.

7. The method of claim 6 further comprising the step of separating and removing soap contained in said second portion of liquid in said liquor tank.

8. The method of claim 7, wherein said liquor tank includes a primary compartment and a secondary compartment, in liquid contact with each other, and including transferring said second portion of liquid to said secondary compartment in said liquor tank.

9. The method of claim 8 further comprising the step of separating and removing said soap from said second portion of liquid in said secondary compartment of said liquor tank.

10. The method of claim 9, including utilizing said second portion of liquid from said secondary compartment of said liquor tank for impregnating said lignocellulose-containing material in a subsequent batch of said lignocellulose-containing material.

11. The method of claim 1, further comprising the step of: supplying a third portion of washing liquid to said digester so as to displace a third portion liquid from said digester, said third portion of liquid having a temperature lower than said temperature corresponding to said boiling point of said cooking liquor at atmospheric pressure.

12. The method of claim 1, including utilizing said second portion of liquid for impregnating said lignocellulose-containing material in a subsequent batch of said lignocellulose-containing material.

13. The method of claim 1, including utilizing said displaced second portion of liquid for preheating fresh alkaline cooking liquor portion of said cooking liquor separate from any other displaced portions of liquid from said digester.

14. The method of claim 1, wherein said washing liquid comprises a filtrate from a subsequent wash plant for said kraft pulp.

15. The method of claim 1 wherein said washing liquid is not a cooking liquor.

16. The method of claim 1 wherein said cooking step is a single cooking step.

17. The method of claim 1, further comprising the step of treating a second batch of lignocellulose-containing material with said displaced first portion of said cooking liquor prior to cooking said second batch of lignocellulose-containing material.

* * * * *

UNITED STATES PATENT AND TRADEMARK OFFICE
CERTIFICATE OF CORRECTION

PATENT NO. : 5,643,410

DATED : July 1, 1997

INVENTOR(S) : Hiljanen et al.

It is certified that error appears in the above-identified patent and that said Letters Patent is hereby corrected as shown below:

Column 6, line 6, "hit" should read --hot--.

Column 10, line 3, after "portion" insert --of--.

Column 10, line 13, third line of claim 13, after "alkaline cooking liquor" delete "portion of said cooking liquor separate from any other displaced portions of liquid from said digester." and insert therefor --supplied to said digester in a subsequent batch of said lignocellulose-containing material.--

Signed and Sealed this

Sixteenth Day of December, 1997

*Attest:*

*Attesting Officer*

BRUCE LEHMAN

*Commissioner of Patents and Trademarks*